US008701738B2

(12) United States Patent
Wen et al.

(10) Patent No.: US 8,701,738 B2
(45) Date of Patent: Apr. 22, 2014

(54) CORD CONTROLLER OF WINDOW COVERING

(75) Inventors: Yu-Che Wen, Guishan Township (TW); Chih-Yao Chang, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 60 days.

(21) Appl. No.: 13/182,744

(22) Filed: Jul. 14, 2011

(65) Prior Publication Data

US 2012/0304421 A1 Dec. 6, 2012

(51) Int. Cl.
*E06B 9/324* (2006.01)

(52) U.S. Cl.
USPC ..... 160/178.2

(58) Field of Classification Search
USPC ..... 160/178.2, 173 R, 168.1 R, 177 R
See application file for complete search history.

(56) References Cited

U.S. PATENT DOCUMENTS

| | | | | | |
|---|---|---|---|---|---|
| 3,952,789 | A * | 4/1976 | Marotto | ..... | 160/168.1 R |
| 4,180,118 | A * | 12/1979 | Vecchiarelli | ..... | 160/178.2 |
| 4,413,664 | A * | 11/1983 | Istha | ..... | 160/178.2 |
| 4,463,791 | A * | 8/1984 | McClure | ..... | 160/178.2 |
| 4,488,588 | A * | 12/1984 | McClure | ..... | 160/178.2 |
| 4,955,420 | A * | 9/1990 | Marinescu et al. | ..... | 160/178.2 |
| 2007/0102125 | A1 * | 5/2007 | Nien et al. | ..... | 160/178.2 |
| 2009/0065155 | A1 * | 3/2009 | Liu | ..... | 160/177 R |

* cited by examiner

*Primary Examiner* — David Purol
(74) *Attorney, Agent, or Firm* — Tracy M. Heims; Apex Juris, pllc

(57) ABSTRACT

The present invention provides a cord controller to be mounted on a top rail of a window covering. The cord controller includes a base, a cord controlling device, and a cord regulating device. The base has a chamber therein and an inlet and an outlet on opposite sides of the chamber, and the cord controlling device and the cord regulating device are received in the chamber. The cord controlling device has a gap between the inlet and the outlet for the cord to pass through. The cord regulating device is adjacent to the outlet and has cord pressing bar to form a passageway between the cord pressing bar and the base for the cord to pass through. Therefore, the cord controller may avoid the cords twisting and keep a smooth movement of the cords.

6 Claims, 6 Drawing Sheets

CORD CONTROLLER OF WINDOW COVERING

BACKGROUND OF THE INVENTION

1. Field of the Invention

The present invention relates generally to a window covering, and more particularly to a cord controller of a window covering.

2. Description of the Related Art

Window coverings, such as window blinds, usually have a top rail, a bottom rail, and a blanket or slats between the top and bottom rails. Conventional window blinds have a cord to be operated to fold or unfold the window blind. FIG. 1 shows a conventional cord controller 1 mounted on the top rail, including a base 2, in which a roller and a brake wheel are provided. A plurality of cords 5 pass through a space between the roller 3 and the brake wheel 4. It may fasten or loose the cords 5 by controlling the brake wheel 4. Such cord controller 1, however, still has some drawbacks, including:

1. The cords move relative to the roller 3 and the brake wheel 4 when the window blind is folded and unfolded. It will twist the cords 5 and the twisted cords interfere with the roller 3 and the brake wheel 4 that the cords 5 is hard to be pulled.

2. The purpose of the roller 3 is to reduce the friction of the cords 5. It is impossible to mount plural of rollers in the base. It needs an axle for the roller to rotate. However, the rusting axle 3*a* or dust on the axle 3*a* will cause the roller 3 hard to rotate, and therefore, it will increase the friction between the roller 3 and the cords 5. This problem is not easy to find that it always misses the best time to fix it. Besides, the axle 3*a* makes the roller hard to be assembled.

SUMMARY OF THE INVENTION

The primary objective of the present invention is to provide a cord controller to avoid the problem of twisting cords.

According to the objective of the present invention, a cord controller of a window covering includes a base, a cord controlling device, and a cord regulating device. The base has a chamber therein and an inlet and an outlet on opposite sides of the chamber, and the cord controlling device and the cord regulating device are received in the chamber. The cord controlling device has a gap between the inlet and the outlet for the cord to pass through. The cord regulating device is adjacent to the outlet and has cord pressing bar to form a passageway between the cord pressing bar and the base for the cord to pass through.

In an embodiment, the cord regulating device further has at least a lateral bar on an end of the cord pressing bar to engage the base.

In an embodiment, the base has two vertical walls, and the cord pressing bar of the cord regulating device has opposite end connected to the vertical walls.

In an embodiment, a height of the passageway is less than 1.5 times of a diameter d of the cord, and a width of the passageway is greater than 2 times of a diameter d of the cord.

In an embodiment, the passageway is on a horizontal path of the cord.

In an embodiment, the cord controlling device has a controlling wheel pivoted on the base and a guiding member mounted on the base, and the gap is between the controlling wheel and the guiding member.

In an embodiment, the cord controlling device further has a wear-resisting sheet mounted on the guiding member. With the structure as described, it may avoid the cords twisting.

DETAILED DESCRIPTION OF THE INVENTION

Figure 1:
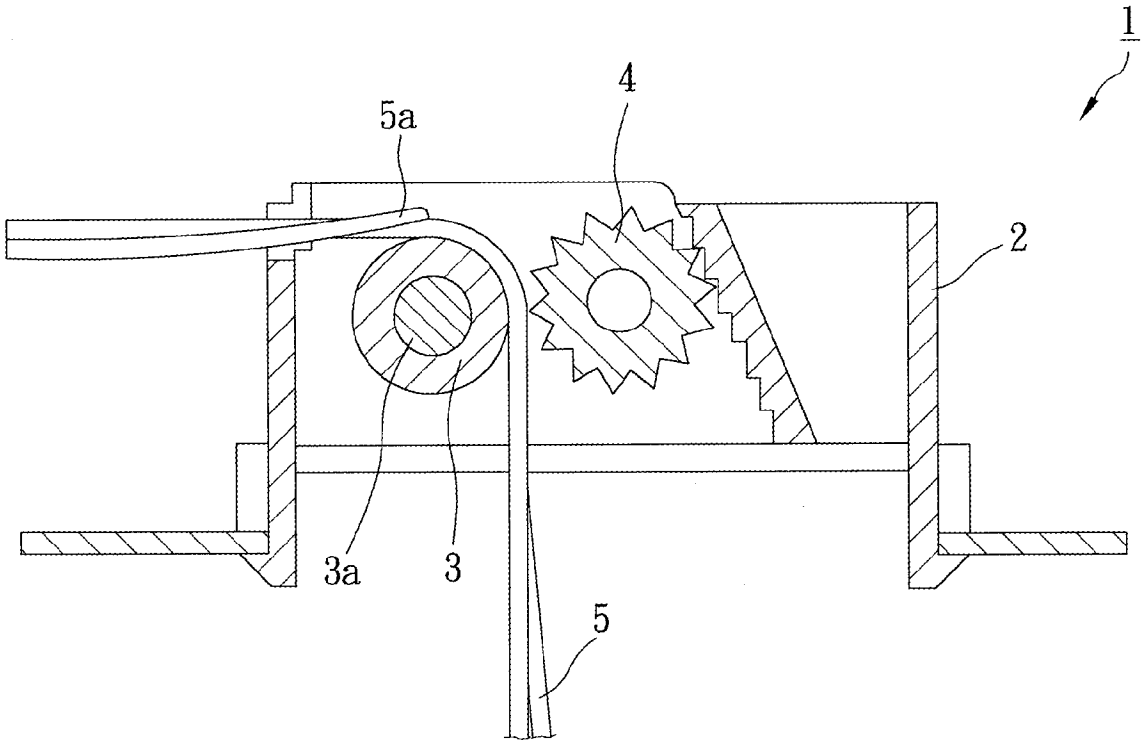
FIG. 1 (PRIOR ART)
FIG. 1 is a sectional view of the conventional cord controller.
Figure 2:
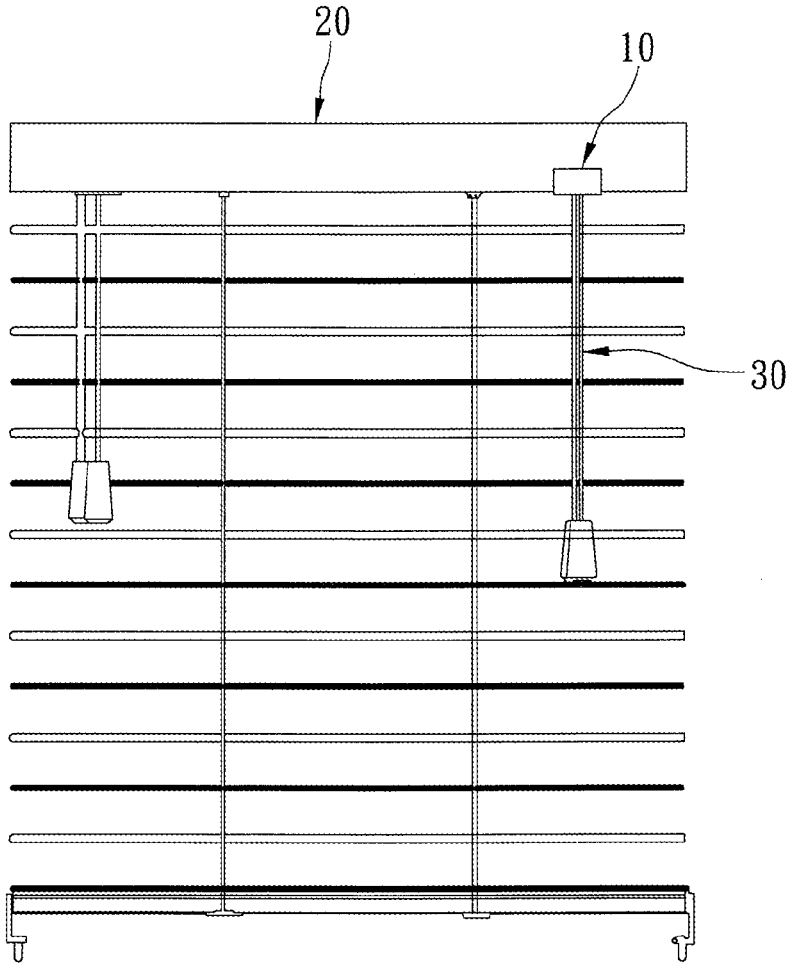
FIG. 2 is a front view of the window covering of a first preferred embodiment of the present invention.

As shown in FIG. 2, a cord controller 10 of the first preferred embodiment of the present invention is mounted on a top rail 20 of a window covering, and a plurality of cords 30 pass through the cord controller 10.

Figure 3:
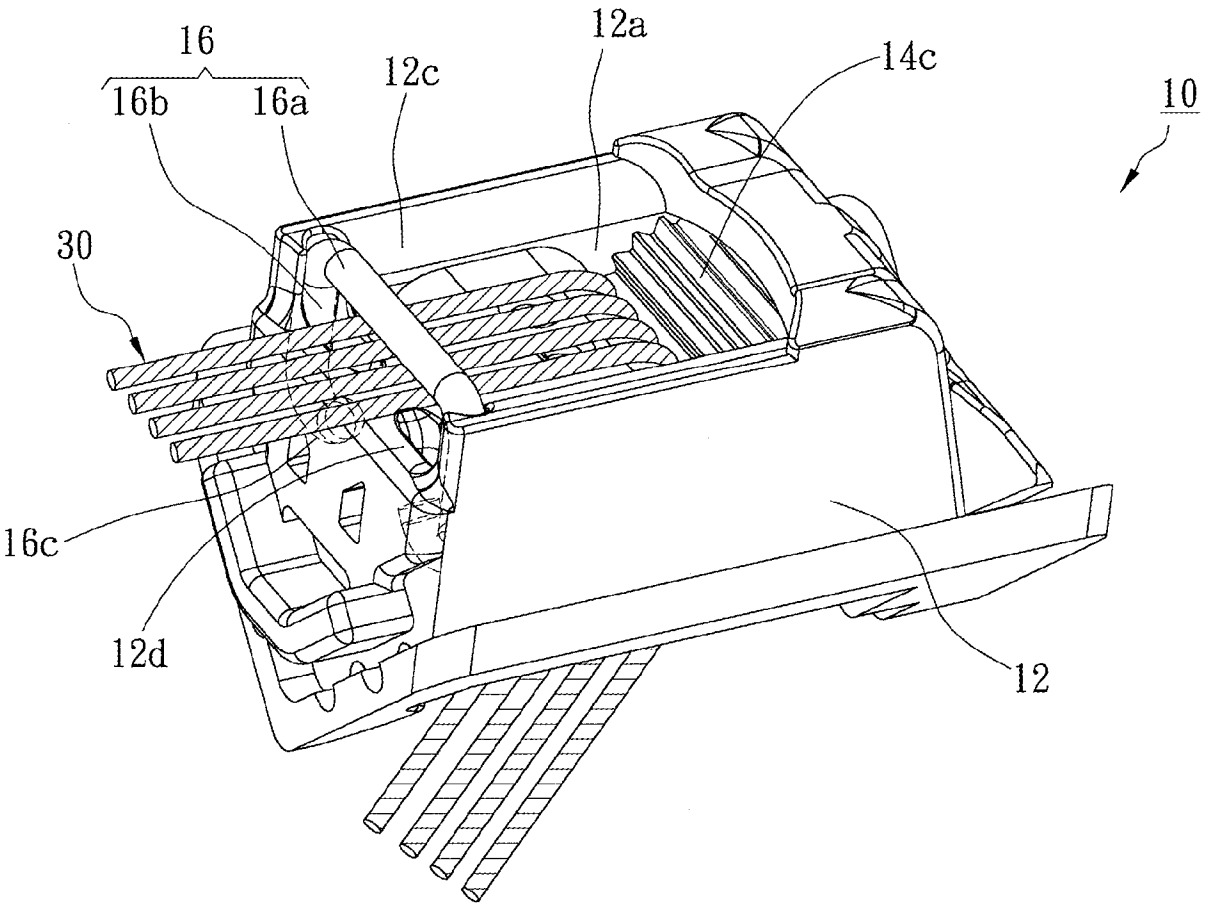
FIG. 3 is a perspective view of the cord controller of the first preferred embodiment of the present invention.
Figure 4:
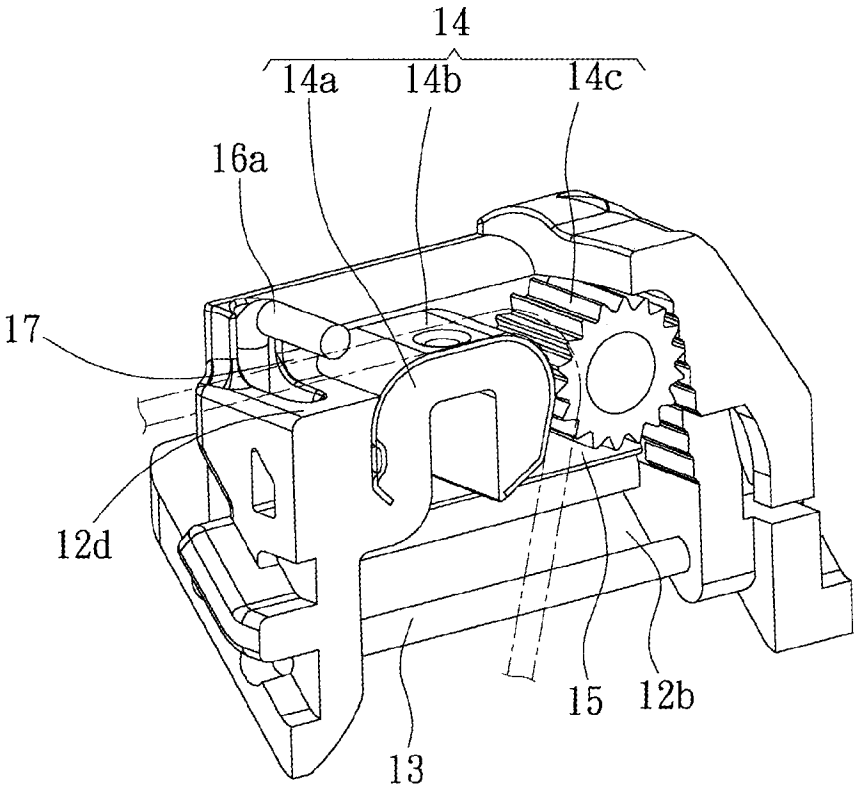
FIG. 4 is a partial sectional view of the cord controller of the first preferred embodiment of the present invention.

As shown in FIG. 3 and FIG. 4, the cord controller 10 includes a base 12, a cord controlling device 14, and a cord regulating device 16.

The base 12 has a chamber 12*a* therein, an inlet 12*b* and an outlet 12*c* on opposite sides of the chamber 12*a*. The base 12 is provided with a plurality of posts 13 adjacent to the inlet 12*b*, and a supporting member 12*d* adjacent to the outlet 12*c*. The posts 13 may separate the cords 30 entering the base 12, and the supporting member 12*d* is a surface in the chamber 12*a*. The base 12 may be made from plastic injection molding, and the above elements may be formed in the injection molding.

The cord controlling device 14 has a guiding member 14*a*, a wear-resisting sheet 14*b*, and a controlling wheel 14*c*. The guiding member 14*a* is on a sidewall of the chamber 12*a*, on which the wear-resisting sheet 14*b* is provided. The wear-resisting sheet 14*b* is a metal sheet in the present invention with a smooth surface. The controlling wheel 14*c* is received in the chamber 12*a* and is pivoted on the base 12. A gap 15 is formed between the guiding member 14*a* and the controlling wheel 14*c* that the cords 30 may enter the base 12 via the inlet 12*b*, pass the gap 15 between the guiding member 14*a* and the controlling wheel 14*c*, and leave the base via the outlet 12*b*.

The cord regulating device 16 in the present invention is a metallic bar bent to form a horizontal cord pressing bar 16*a*, two vertical lateral bars 16*b* on opposite ends of the cord pressing bar 16*a*, and two hooks on tails of the lateral bars 16*b*. As shown in FIG. 3, the lateral bars 16*b* of the cord regulating device 16 engage slots on the sidewall of the chamber 12*a* of the base 12 adjacent to the outlet 12*c*. it is noted that the cord regulating device 16 and the base 12 are made of the same material, in other words, the cord regulating device 16 and the base 12 may be integrated into a single unit.

Figure 5:
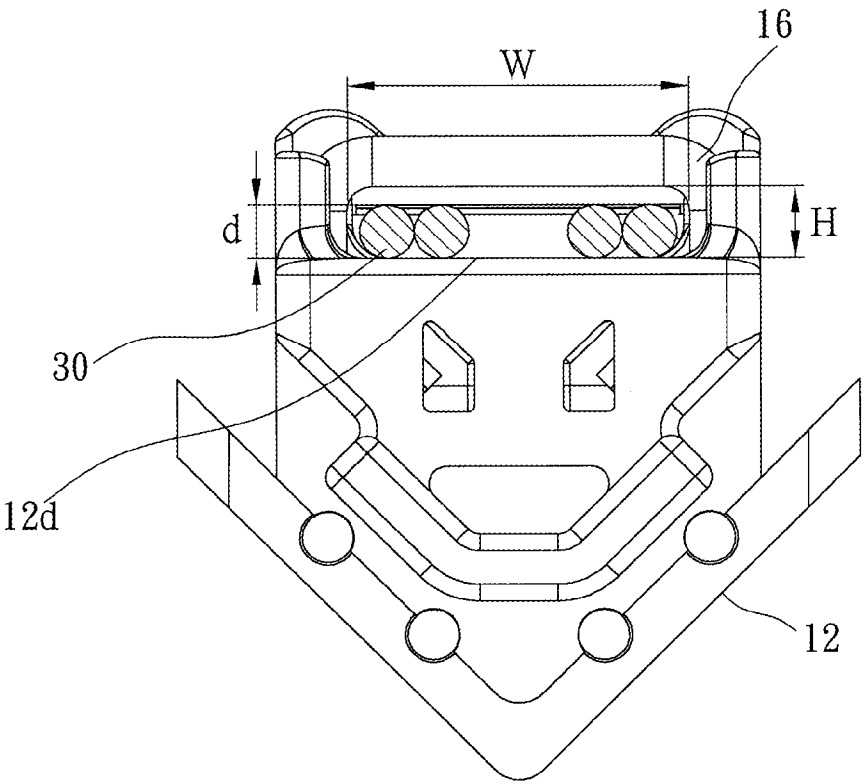
FIG. 5 is a lateral view of FIG. 4.

It forms a passageway 17 between the cord pressing bar 16*a* and the supporting member 12*d* for the cords 30 to pass through. As shown in FIG. 5, it is preferable that a height H of the passageway 17 is less than 1.5 times of a diameter d of the cord 30, and a width W thereof is greater than 2 times of the diameter d of the cord 30 to avoid the cords 30 to twist when they are moving. It is preferable that the passageway 17 is on the horizontal path of the cords 30 to keep smooth movements of the cords 30.

Figure 6:
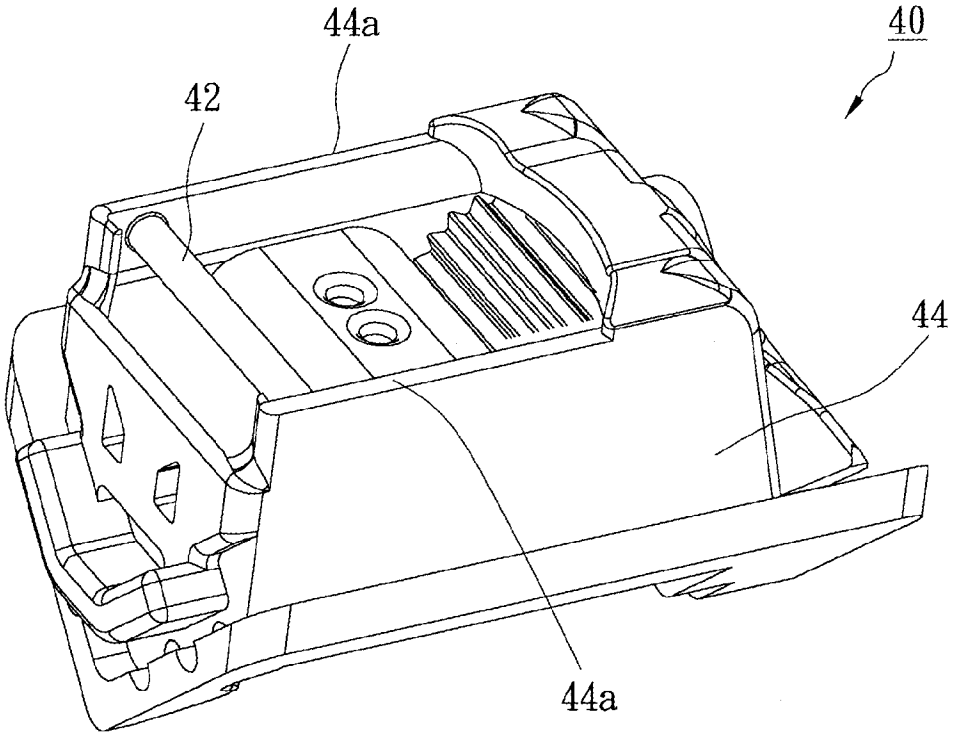
FIG. 6 is a perspective view of the cord controller of a second preferred embodiment of the present invention.

FIG. 6 shows a cord controller 40 of the second preferred embodiment of the present invention, which is similar to the cord controller 10 of the first preferred embodiment, except that:

A cord regulating device 42 in the second preferred embodiment is simply a straight bar with opposite end connected to two vertical walls 44*a* of a base 44. The straight bar forms the cord pressing bar 16*a* of above to avoid the cords twisting just the same as above.

The description above is a few preferred embodiments of the present invention and the equivalence of the present invention is still in the scope of claim construction of the present invention.

What is claimed is:

1. A cord controller of a window covering, which is mounted on a top rail of the window covering for at least a cord to pass through, comprising:

a base having a chamber therein, and an inlet and an outlet on opposite sides of the chamber;

a cord controlling device, which is received in the chamber of the base, having a gap between the inlet and the outlet for the cord to pass through, where said cord controlling device further includes a rotatable controlling wheel pivoted on the base and a guiding member mounted on the base, and the gap is between the controlling wheel and the guiding member;

a cord regulating device, which is received in the chamber of the base and adjacent to the outlet, having a bar that is bent to form a horizontal cord pressing bar, two vertical lateral bars on opposite ends of said cord pressing bar to engage said base, and inwardly facing hook on tails of the lateral bars, wherein a passageway is formed between the cord pressing bar and the base for the cord to pass through;

wherein a height of the passageway is less than a diameter of two cords in order to prevent said cords from twisting; and wherein the base comprises a plurality of posts adjacent to the inlet.

2. The cord controller as defined in claim 1, wherein the base has two vertical walls, and the cord pressing bar of the cord regulating device has opposite end connected to the vertical walls.

3. The cord controller as defined in claim 1, wherein said height of the passageway is less than 1.5 times of said diameter of the cord, and a width of the passageway is greater than 2 times of said diameter of the cord.

4. The cord controller as defined in claim 1, wherein the passageway is on a horizontal path of the cord.

5. The cord controller as defined in claim 1, wherein the cord controlling device further has a wear-resisting sheet mounted on the guiding member.

6. The cord controller as defined in claim 1, wherein the cord regulating device and the base are integrated into a single unit.

* * * * *